US005179840A

United States Patent [19]

Worsfold

[11] Patent Number: 5,179,840

[45] Date of Patent: Jan. 19, 1993

[54] CRYOGENIC TREATMENT METHODS

[75] Inventor: Jonathan P. Worsfold, Horsham, England

[73] Assignee: The BOC Group plc, Windlesham, England

[21] Appl. No.: 595,896

[22] Filed: Oct. 11, 1990

[30] Foreign Application Priority Data

Oct. 16, 1989 [GB] United Kingdom ..... 8923260
May 31, 1990 [GB] United Kingdom ..... 9012181

[51] Int. Cl.[5] ..... F25D 17/02
[52] U.S. Cl. ..... 62/64; 8/158; 43/124; 62/52.1; 134/22.12; 134/37
[58] Field of Search ..... 62/64, 320, 52.1; 43/124; 134/22.12, 34, 37, 42; 8/158; 15/321, 322

[56] References Cited

U.S. PATENT DOCUMENTS 3,874,926 4/1975 Horne et al. ..... 134/22.12
4,624,070 11/1986 Query et al. ..... 43/124
4,720,889 1/1988 Grave ..... 15/322
4,972,677 11/1990 Moriya et al. ..... 62/303
5,027,546 7/1991 Tallon ..... 43/124

FOREIGN PATENT DOCUMENTS 2620745 3/1989 France .
2634996 2/1990 France .
2153660 8/1985 United Kingdom .

OTHER PUBLICATIONS

M. J. Colloff, "Use of Liquid Nitrogen in the Control of House Dust Mite Population", *Clinical Allergy*, vol. 16, pp. 41–47 (1986).
British Oxygen Co., *Cryogenics*, "$LN_2$ Frees the Downtrodden", Guilford GB, vol. 13, No. 5 (May 1973).

*Primary Examiner*—Ronald C. Capossela
*Attorney, Agent, or Firm*—Carol A. Nemetz; Larry R. Cassett

[57] ABSTRACT

An article such as a mattress, carpet or curtain is treated by spraying its surface with liquid cryogen (usually liquid nitrogen). The liquid nitrogen acts as an acaricide and kills house dust mites. The dead mites are then removed from the freshly sprayed fabric. Such a treatment is also effective in dislodging particles of dirt from the articles and may be used for example to clean a carpet in situ. After treatment with the liquid nitrogen, the carpet may be subjected to a conventional vacuum cleaning.

10 Claims, 4 Drawing Sheets

FIG. 1
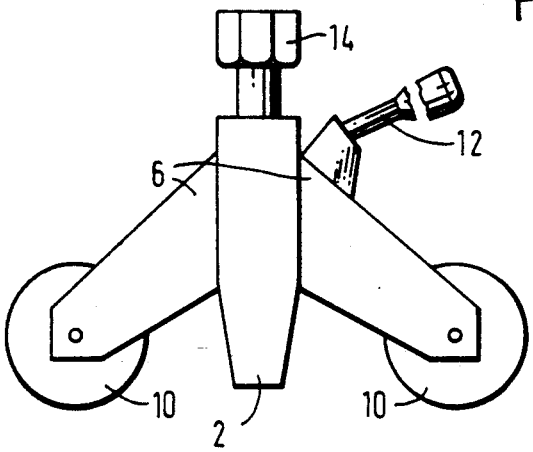
FIG. 2
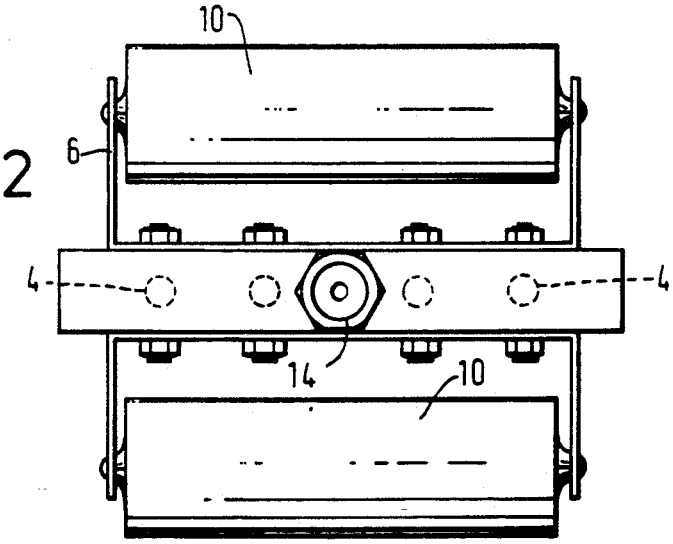
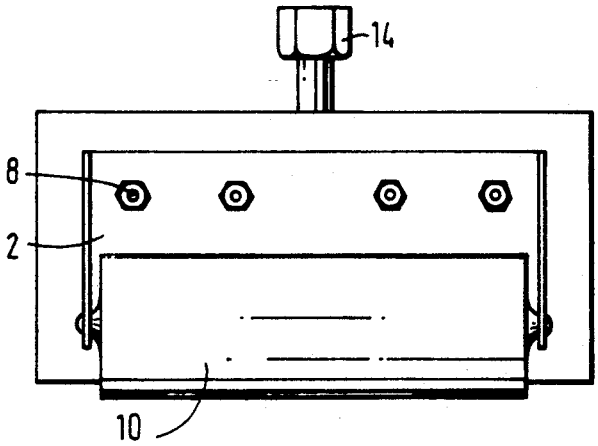
FIG. 3

CRYOGENIC TREATMENT METHODS

The present invention relates to a cryogenic treatment method and apparatus for controlling the population of house dust mites in articles having surfaces formed of natural or synthetic fabric, for example mattresses and carpeting. It also relates to a cleaning method for dislodging particulate contaminants (e.g. dirt) from porous articles.

M J Coloff reports on the use of a cryogen, liquid nitrogen, as an acaricide in "Use of liquid nitrogen in the control of house dust mite populations", Clinical Allergy, 1986, Volume 16, pages 41 to 47. It is well known that house dust mites are responsible for the production of potent allergens and that these allergens are a major cause of allergic asthma. Coloff describes a method of treating a mattress with liquid nitrogen. The mattress is completely soaked in liquid nitrogen. It is then allowed to stand for 15 minutes and is thereafter subject to vacuum (i.e. suction) cleaning. Practical tests of this method show that it was effective in reducing the number live mites in mattresses when compared to vacuum cleaning alone.

Colloff's method suffers from two main disadvantages. First, as the mattress thaws so it becomes wet from condensation of water vapour, thus making difficult subsequent removal of the dead mites (and faecal pellets) from the mattress. Second, soaking the mattress in liquid nitrogen results in the consumption of unnecessarily large quantities of the liquid nitrogen.

The present invention relates to an improved method and apparatus for the treatment of fabric surfaces which reduces the disadvantages associated with the above-described methods.

According to a first aspect of this invention there is provided a method of treating an article having a fabric surface comprising spraying the surface with liquid cryogen and then removing dead mites from the freshly sprayed surface.

By spraying the fabric with the liquid cryogen, the consumption of the cryogen can be carefully controlled. Removing dead mites from the freshly sprayed fabric keeps to a minimum problems in removing the dead mites that are associated with condensation of moisture on the fabric. Indeed, since a treatment of one second at −80° C. is effective to kill substantially all mites on the surface, each region of the surface may be cleaned to remove mites in accordance with the invention within 15 seconds of being sprayed and we prefer that the period of time that elapses between a particular area being sprayed and being cleaned be no more than 1 minute.

The liquid cryogen is preferably liquid nitrogen although liquid argon is a feasible alternative. Since liquid nitrogen has a temperature of minus 196° C., prolonged spraying of the fabric is not required. Indeed, the acaricidal effect of liquid nitrogen approximates to being instantaneous, so once a particular portion of a fabric surface has been sprayed, there is no need to respray on that portion. Great care needs to be taken when using liquid nitrogen in a household environment so as to ensure that any nitrogen vapour entering the atmosphere does not result in the oxygen concentration falling to an unsafe level. Accordingly, if the method according to the invention is performed indoors, the room where it is performed needs to be well ventilated and the oxygen concentration in the room should be repeatedly or continuously monitored.

The method according to the invention may be used to treat mattresses, bedding, carpeting and curtains in particular. Carpeting and curtains may be treated in-situ. In one preferred apparatus according to the invention, there is a common mounting for a liquid cryogen spray head and a suction head. For in-situ treatment of fabrics the common mounting may take the form of a guide plate adapted to perform the functions of holding the spray head and vacuum head generally perpendicular to the surface to be treated (when the plate is positioned thereupon) and acting as a shield to deflect downwards that cold gas evolving from evaporating liquid cryogen and reduce the amount of cold gas passing directly into the vacuum head without first coming into contact with the fabric. Alternatively the spraying of the liquid nitrogen and the subsequent suction treatment may be independent operations.

The treatment of mattresses in accordance with the invention is particularly important as relatively high numbers of dust mites tend to populate mattresses. Mattresses are preferably treated in a chamber having means for supporting the mattress, mountings for a liquid cryogen spray head and a suction head. There are preferably two spray heads and two suction heads arranged to enable both top and bottom (i.e. the two major surfaces) of the mattress to be treated simultaneously. The chamber is preferably provided with guide rails along which the heads can be moved in operation of the apparatus. Typically, movement of the heads may be effected by remove control. Once treatment of a mattress in accordance with the invention in the chamber has been finished, the mattress is allowed to return to ambient temperature in the chamber. To speed the return to ambient temperature, the chamber preferably has at least one fan and may also be provided with a heater. Alternatively, a mattress may be treated in a manner similar to curtains and carpets.

In treating mattresses and other articles in accordance with the invention, it needs to be appreciated that some mites will live near to but below the actual fabric surface. Accordingly, the liquid cryogen is preferably sprayed under a pressure sufficient to the liquid cryogen itself or cold vapour evolved therefrom to penetrate beneath the surface of the fabric. Accordingly, the liquid cryogen is preferably sprayed under a pressure appreciably above atmospheric pressure. Typically, the pressure is in the range of 1.3 to 2 atmospheres absolute. Such pressures can readily be generated in commercially available Dewar vessels for dispensing liquid nitrogen.

In performing the method according to the first aspect of the invention, we have discovered that the treatment with liquid nitrogen or other liquid cryogen of a porous article, for example a carpet, is a particularly effective method of removing dirt from the pores of the article. Indeed, the effect has been so dramatic as to restore the blue colour of a regularly vacuum cleaned carpet which appeared brown in colour as a result of deeply lying dust and grit not removed by the vacuum cleaning.

According to a second aspect of the present invention there is provided a method of cleaning a porous article including causing liquid cryogen to penetrate the pores of the article in sufficient quantity that on evaporation the cryogen expands in the pores and displaces particulate contaminants from the article.

Flow of cryogenic vapour out of the articles from a surface opposite that at which the liquid cryogen is directed is preferably so obstructed or prevented that at least most of the vapour leaves the article from the surface at which the liquid cryogen is directed. If the article being cleaned is a carpet in situ then either an impermeable underlay or the floor may act as the obstructing means. In other instances, an obstructing means may need to be specially fitted. For example, in the cleaning of industrial filters, the chamber in which the filter is located may be closed on one side by means of a removable or demountable plate or the like specially fitted for the purpose and liquid nitrogen directed at the filter from the other side. The particles that emanate from said other side of the filter may be removed by suction.

Preferably, in performing the cleaning method according to the second aspect of this invention, a stream of pressurised liquid cryogen is formed and then directed at a surface of the article to be cleaned in the form of one or more jets or sprays. The stream of liquid cryogen is preferably subjected to a pressure of at least 2 bar absolute (typically, the pressure is in the order of 2.5 bar absolute).

The amount of liquid cryogen that needs to be applied per unit surface area of the article to be cleaned will vary in accordance with the nature of the article and the amount of particulate contaminants that it contains. In experiments relating to the cleaning of carpets, we have found that from 0.2 to 1 liter of liquid nitrogen per $m^2$ of carpet is generally suitable depending on the nature of the carpet.

The liquid cryogen is preferably directed at the surface by being sprayed thereat. If the angle subtended by the sprays is insufficient to cover the whole of the surface, for example if the article is a carpet, then the spray device may be moved across the area of the article at a uniform rate so as to apply the liquid cryogen uniformly. Typically, when cleaning carpets in situ, the spray device may be moved over the carpet manually.

The particulate contaminants moved from the article by the vaporising liquid cryogen are preferably collected, for example by suction and then disposed of. Preferably, the liquid cryogen is sprayed at the article from relatively close thereto, say, a distance less than 2 cm. In performing the method according to the invention, care should be taken not to cause damage to the article being cleaned. For example, in cleaning carpets formed of synthetic fibres, the liquid cryogen tends to embrittle the fibres. Accordingly, care should be taken not to walk on such a synthetic carpet that has been freshly treated with liquid cryogen.

The method according to the second aspect of the invention may be used to clean a wide range of porous articles and not merely carpets and industrial filters.

Methods and apparatuses according to the invention will now be described by way of example with reference to the accompanying drawings, in which:

FIG. 1 is a side view of a mounted liquid nitrogen spray head for use in the invention;

FIG. 2 is a plan view of the spray head shown in FIG. 1;

FIG. 3 is a front view of the spray head shown in FIG. 1;

Figure 4:
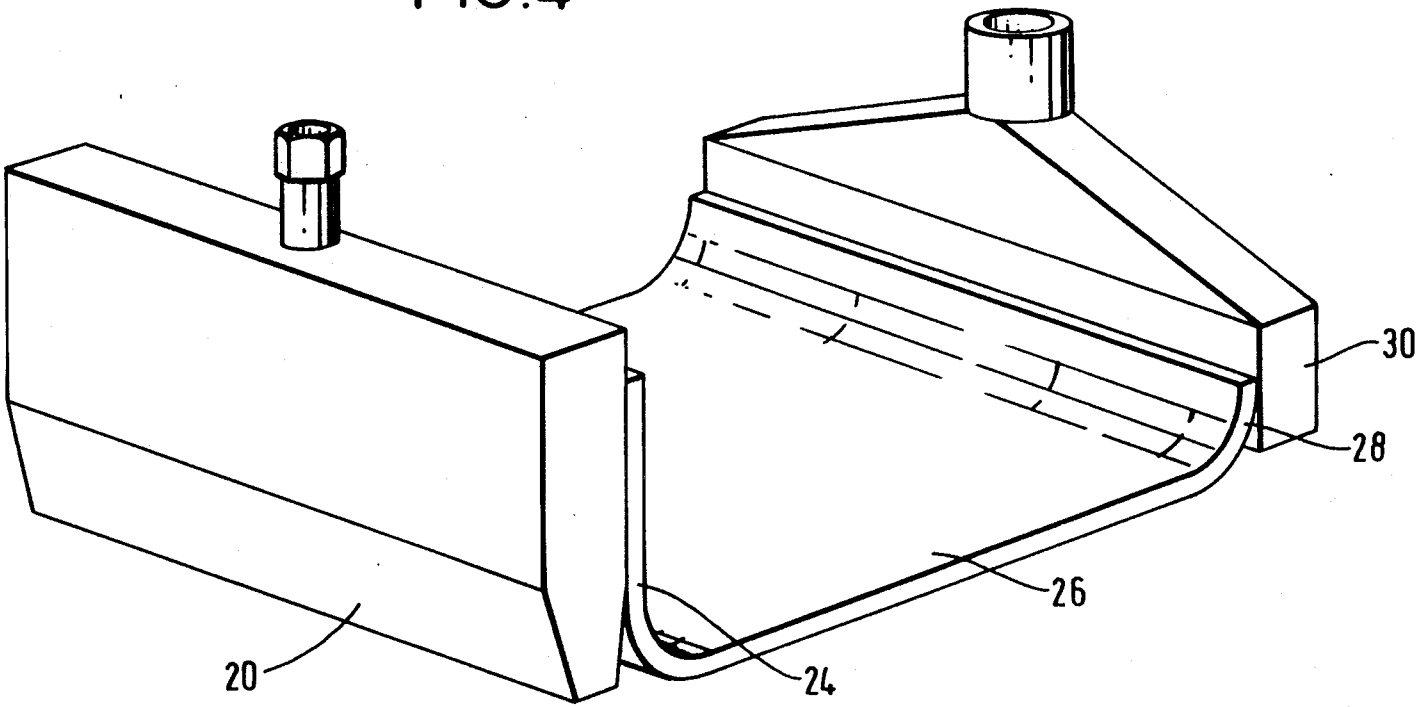
FIG. 4 is a schematic perspective view of an apparatus according to the invention combining a liquid nitrogen spray head with a suction head.

The drawings are not to scale.

Referring to FIGS. 1 to 3 of the drawings, the illustrated apparatus includes a spray head 2 formed of stainless steel or other material not embrittled at liquid nitrogen temperatures having a plurality of small orifices 4 (see FIG. 2) communicating with a conduit (not shown) for the passage of liquid nitrogen. The orifices typically each have a diameter of 1 mm. The spray head 2 is mounted by bolts 8 to a frame 6 which carries guide rollers 10. The spray head 2 has a handle 12 whereby an operator may wheel it along the surface to be sprayed with liquid nitrogen. The spray head 2 also has a connector 14 to enable it to receive a hose (not shown) of suitable material to enable liquid nitrogen to be passed from a source thereof (not shown) to the spray head 2.

In use of the apparatus shown in FIGS. 1 to 3, the spray head 2 may be wheeled manually across the surface to be sprayed and liquid nitrogen jets discharged under pressure from the orifices 4 to penetrate that surface. Within 15 seconds of being first contacted by the liquid nitrogen each part of the surface has applied thereto a suction so as to remove dead dust mites and faecal pellets. The liquid nitrogen acts as an acaricide and also has the effect of embrittling the dust mites (particularly their legs) thereby facilitating their removal by suction.

Referring now to FIG. 4 of the drawings, the illustrated apparatus includes a liquid nitrogen spray head 20 connectible by a connector 22 to a hose (not shown) extending from a source (not shown) of liquid nitrogen under pressure. The spray head 20 is generally similar to the spray head 2 shown in FIGS. 1 to 3 of the accompanying drawings. The spray head 20 is mounted to a first upturned end 24 of a guide plate 26. The plate 26 has a second upturned end 28 to which the head 30 of a suction (or vacuum) cleaner (not shown) is connected. In operation, the apparatus shown in FIG. 4 is moved steadily over the fabric surface to be treated and jets of liquid nitrogen are sprayed onto the surface at a sufficient pressure and hence velocity for them to penetrate the surface of the fabric and thereby kill substantially all dust mites that it impinges upon. The plate 26 prevents direct passage of cold nitrogen vapour into the suction head 30. Typically, about a second after a particular portion of a fabric surface has been sprayed with liquid nitrogen, the head 30 moves over that portion and thereby removes by suction dead mites and the like from the surface.

Figure 5:
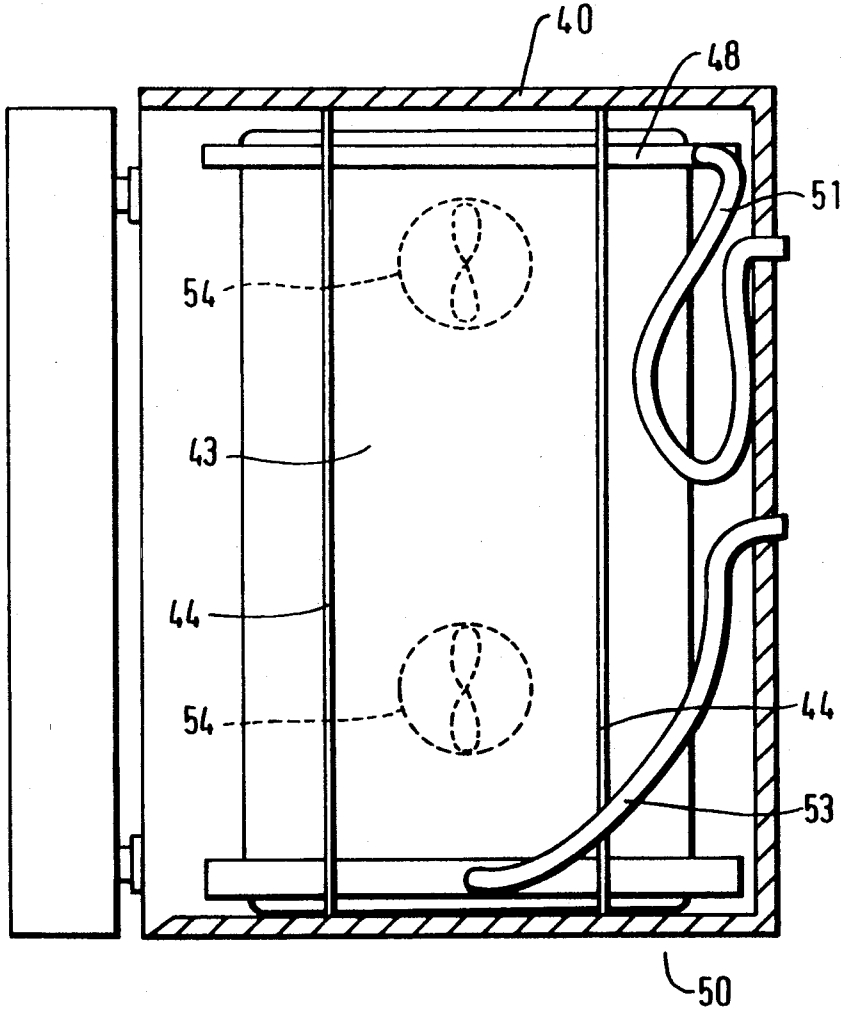
FIG. 5 is a schematic end evaluation, partly in section, of a chamber for treating mattresses in accordance with the invention.
Figure 6:
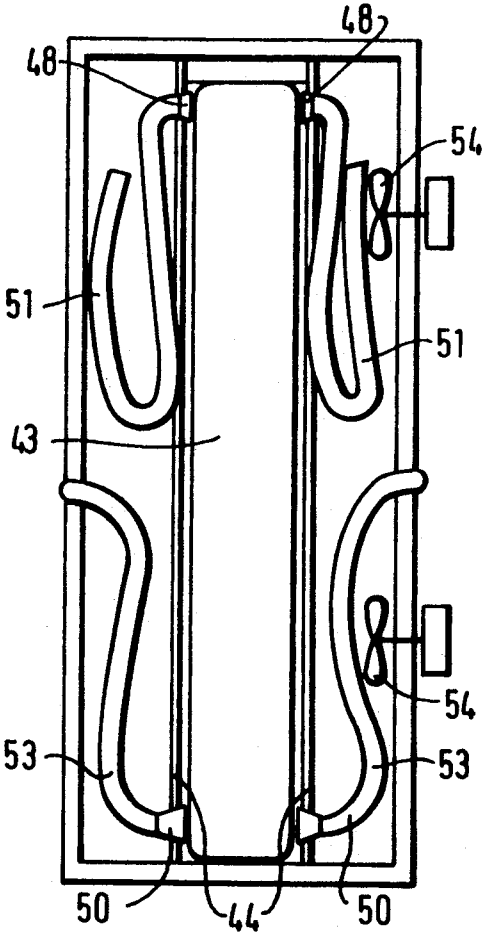
FIG. 6 is a side view of the chamber shown in FIG. 5.

Referring now to FIGS. 5 and 6 of the drawings, there is shown a cabinet or chamber 40 having a door 42. In use, a mattress 43 is loaded into the cabinet 40 through the door 42. The door 42 is then closed and stood vertically in suitable retaining means (not shown) between two pairs 44 and 46 respectively of vertical guide rails. Each pair 44 and 46 of guide rails has associated therewith a liquid nitrogen spray head 48 and a suction head 50. The head 48 communicates with a hose 51 leading to a source (not shown) of liquid nitrogen. The head 50 communicates via a hose 53 with a source of suction (not shown). Both the top and bottom surfaces of the mattress (when stood on its side) are able to be sprayed with liquid nitrogen and then to be subjected to suction cleaning. Typically, means (not shown) are provided to move the heads automatically along the rails. In one arrangement the liquid nitrogen spray heads 48 are moved steadily along their respective pairs of rails from top to bottom of the cabinet 40, spraying with liquid nitrogen the top and bottom surfaces of the mattress as they advance. The nitrogen is typically supplied at a pressure sufficient to penetrate at least an inch beneath each surface. Once the translation of the nitrogen spray heads has been completed, the suction heads 50 may be moved along their respective rails so as to apply a suction to the sprayed fabric surface. Typically, the total spraying and suction operation may taken no more than 30 seconds. The cabinet 40 is also provided with a plurality of fans 54. On completion of the suction operation, the fans 54 may be actuated and the door 42 reopened so as to cause the mattress to be returned to ambient temperature in a relatively short space of time. If desired, the cabinet 40 may also be provided with electrical heating elements (not shown) to enable the temperature of the chamber to be returned to ambient more rapidly.

Typically, to treat both top and bottom surfaces of a mattress each 2 meters long by 1.5 meters wide in accordance with the invention, 2 liters of liquid nitrogen supplied at a pressure of 1.5 bar absolute, may be used. Typically, the mattress may be treated in accordance with the invention at regular intervals, say every two or three months.

Typically, when treating a room occupied by, say, an asthma sufferer, all the fabric surfaces there may be sprayed with liquid nitrogen and then treated with a suction head in accordance with the first aspect of the invention.

Figure 7:
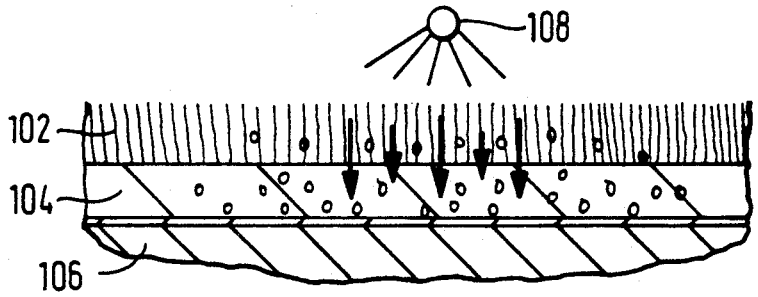
FIGS. 7 and 9 are schematic sectional views of a carpet being cleaned in accordance with the invention.
Figure 8:
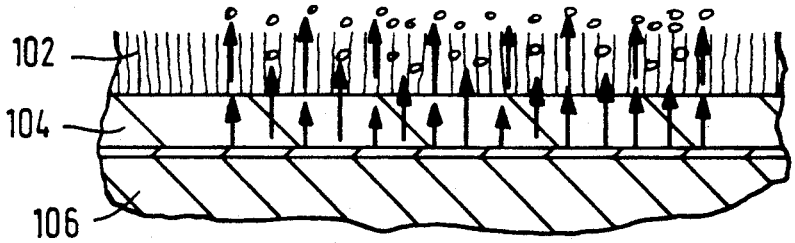
Figure 9:
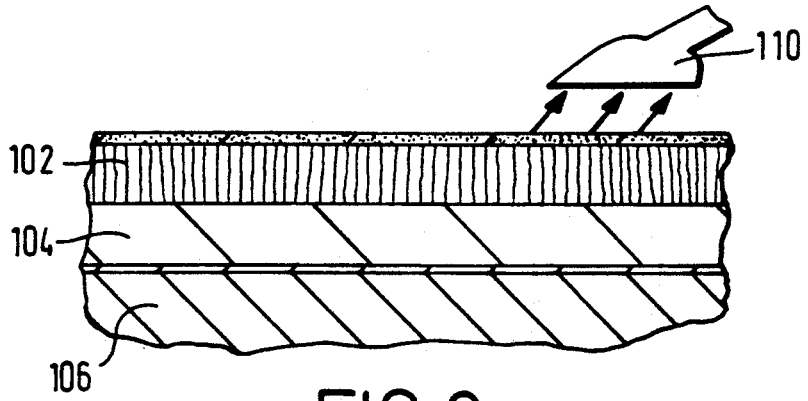

In FIGS. 7 to 9 of the drawings, there is illustrated a carpet in situ. The carpet 102 may be made of any suitable synthetic or natural fibres. If desired, an underlay 104 may be in position between the carpet 102 and the floor 106. The underlay 104 may form part of the carpet or may be separate therefrom. The underlay 104 may be made of any suitable conventional material which may be porous or non-porous.

The carpet 102 is formed by weaving from suitable fibres or yarn, or is made by an analogous process. Accordingly, there will be relatively small interstices between the weave. In continuous use, particles of dust and dirt and grit will tend to become lodged in the pores between the interstices, trapped between the carpet and the underlay, and trapped between the underlay and the solid floor. By spraying liquid nitrogen under a pressure of about 2* bar absolute onto the surface of the carpet 102 from a spray head 108 situated up to about 2 cm above the top surface of the carpet, liquid nitrogen is caused to flow through the pores of the carpet and (if present and if porous) the underlay 104. Since one volume of liquid nitrogen evolves about seven hundred volumes of vapour, on vaporisation there is a large expansion of the cryogen. This expansion has the effect of fluidising particles of dirt, dust and grit within the pores and between the carpet and the underlay, and between the underlay and the floor. Since the cryogen vapour tends to follow the least obstructed path, it carries the fluidised particles upwards through the pores to the surface of the carpet. Indeed, such can be the momentum of developed by the vaporisation of the cryogen, that the particles are lifted well above the surface of the carpet 102 and settle against thereupon. The particles may then be removed by being sucked into a "vacuum" head 110 which may communicate with a collection bag (not shown).

The apparatus shown in FIGS. 1 to 3 may be used to clean the carpet shown in FIGS. 7 to 9. Thus, with reference to FIGS. 1 to 3, the spray head 12 may be wheeled manually across the surface of the carpet to be sprayed and liquid nitrogen jets discharged under pressure from the orifices 14 to penetrate the surface. As described above, the effect of the liquid nitrogen penetrating the carpet and evaporating therein is to throw to the surface of the carpet particulate contaminants contained therein. A suitable time after being first contacted by the liquid nitrogen, the surface of the carpet may have the particles removed therefrom for example by sucking the particles into a collection device.

An apparatus as shown in FIG. 4 of the drawings may alternatively be used to clean the carpet shown in FIGS. 7 to 9. In operation, the apparatus shown in FIG. 4 is moved steadily over the surface of the carpet to be treated and jets of liquid nitrogen is sprayed onto the surface of sufficient pressure and hence velocity for them to penetrate the surface of the carpet and thereby cause particles to be displaced therefrom. The plate 36 prevents direct passage of cold nitrogen vapour into the suction head 40. Typically, about a second after a particular portion of the carpet surface has been sprayed with liquid nitrogen the head 40 moves over that portion and thereby removes by suction particles thrown to the surface.

In experiments relating to the in situ cleaning of carpets using the method according to the invention, we have used 0.25 liters of liquid nitrogen per square meter to clean a foam backed synthetic domestic carpet; 0.5 liters of liquid nitrogen per square meter to clean a woollen domestic carpet with an underlay, and 0.75 liters liquid nitrogen per square meter to clean a heavy duty carpet with an underlay.

What is claimed:

1. A method treating an article having a fabric surface, comprising spraying the surface with liquid cryogen and then removing dead mites from the freshly sprayed fabric, in which the mites are removed from each region of the surface within 1 minute of that region being sprayed.

2. A method as claimed in claim 1, in which the mites are removed from each region of the surface within 15 seconds of that region being sprayed.

3. A method as claimed in claim 1, in which mites are removed by suction.

4. A method as claimed in claim 1, in which the article is a curtain, a carpet or a mattress.

5. A method as claimed in claim 1, in which the liquid cryogen is chosen from the group consisting of sprayed under a pressure of from 1.3 to 2 atmospheres absolute so as to penetrate beneath the surface of the article.

6. A method of cleaning a porous article causing liquid cryogen to penetrate the pores of the article in sufficient quantity that on evaporation the cryogen expands in the pores of the articles and displaces particulate contaminants from the article, in which flow of the vaporized cryogen out of the article from a surface opposite that at which the liquid cryogen is directed is so obstructed or prevented that at least most of the vapour leaves the article from said surface at which the liquid cryogen is directed.

7. A method as claimed in claim 6, in which the article is a carpet and the carpet is cleaned in situ.

8. A method as claimed in claim 7, in which the liquid cryogen is liquid nitrogen and from 0.2 to 1 liter of liquid nitrogen is employed per square meter of carpet.

9. A method as claimed in claim 6, in which a stream of pressurised liquid cryogen is formed and then directed in the form of one or more jets or sprays at a surface of the article to be cleaned.

10. A method as claimed in claim 6, in which the liquid cryogen is liquid nitrogen.

* * * * *